United States Patent [19]

Bauer

[11] 4,239,449

[45] Dec. 16, 1980

[54] SCREW PUMP CONSTRUCTION

[76] Inventor: William J. Bauer, 422 S. Park Rd., LaGrange, Ill. 60525

[21] Appl. No.: 963,388

[22] Filed: Nov. 24, 1978

[51] Int. Cl.[3] ..... F04D 3/00

[52] U.S. Cl. ..... 415/73; 416/177

[58] Field of Search ..... 415/72, 73, 74, 75; 416/176 R, 177; 198/662, 676

[56] References Cited

U.S. PATENT DOCUMENTS

| | | | |
|---|---|---|---|
| 81,938 | 9/1868 | Patric | 415/72 |
| 84,237 | 11/1868 | Waite | 415/72 |
| 1,132,775 | 3/1915 | Hille | 416/177 |
| 1,458,850 | 6/1923 | Rath | 416/177 |
| 3,796,508 | 3/1974 | Rowley | 415/72 |
| 4,019,830 | 4/1977 | Reid | 415/72 |
| 4,170,436 | 10/1979 | Candler | 415/73 |

*Primary Examiner*—Leonard E. Smith

*Attorney, Agent, or Firm*—Neuman, Williams, Anderson & Olson

[57] ABSTRACT

A hydraulic screw pump is provided having a rotatable screw which may comprise a helical blade disposed within an enclosed full or open half cylinder. In half-cylindrical constructions the helical blade rotates relative to a half cylinder which may be formed of concrete. The enclosed screw pumps may have the helical blades welded to the inner periphery of a surrounding metal cylinder so as to rotate therewith, or be welded to said surrounding metal cylinder and also to an inner cylinder which provides axial reinforcement.

In all of the foregoing pump embodiments the improvement of this invention may be utilized to provide increased pump capacity by the novel expedient of flaring the pump discharge end so as to increase the critical depth and critical flow area in said discharge end thus increasing the possible maximum rate of liquid discharge.

2 Claims, 13 Drawing Figures

FIG. 1
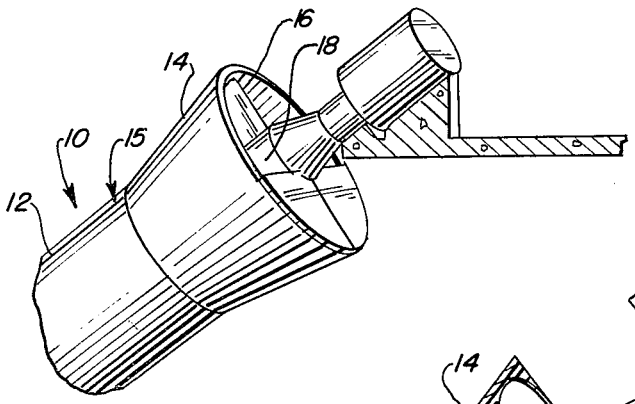
FIG. 2
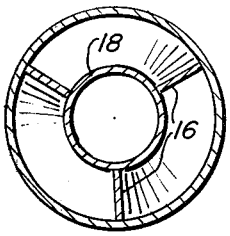
FIG. 3
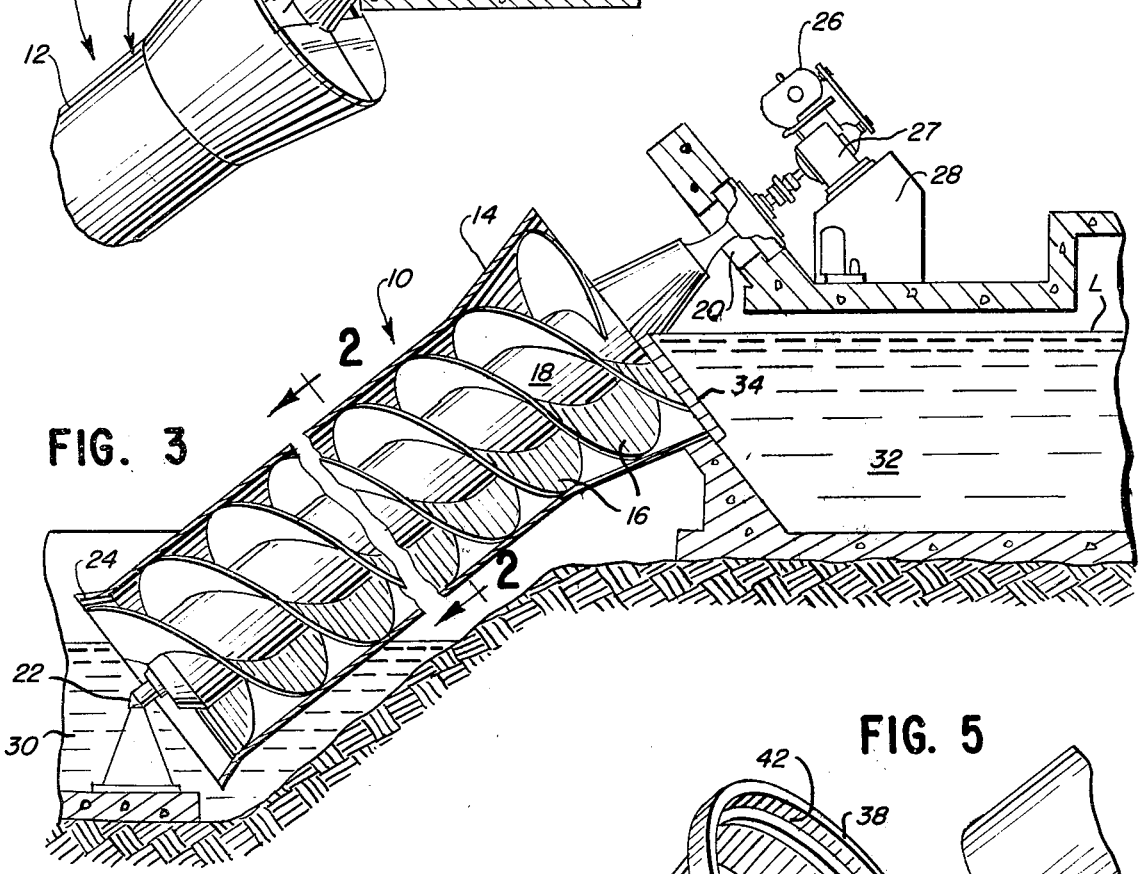
FIG. 5
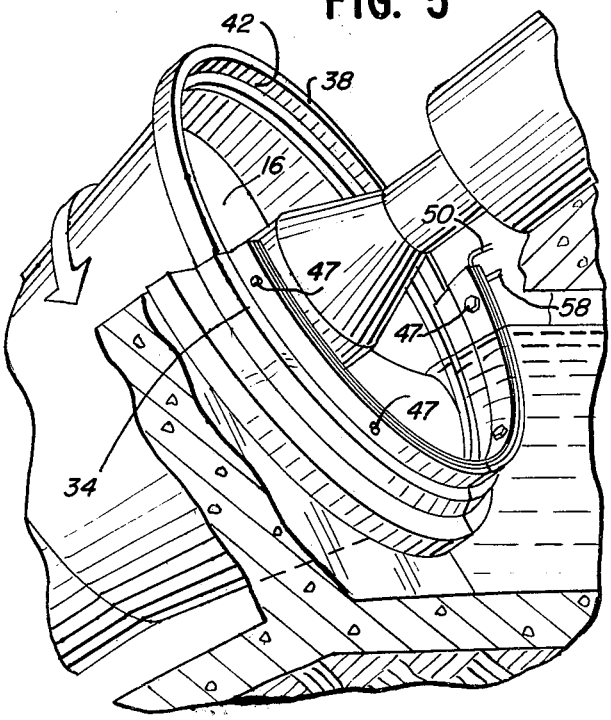
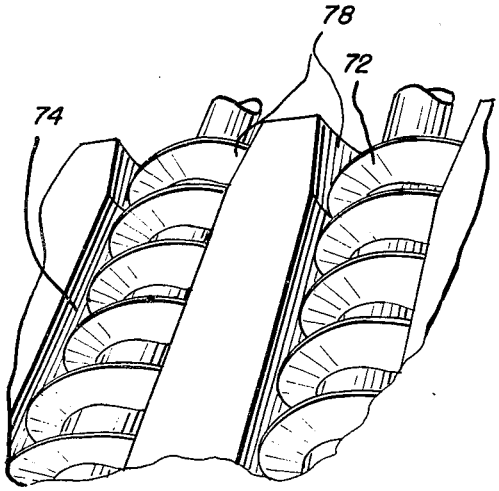
FIG. 4

FIG. 8
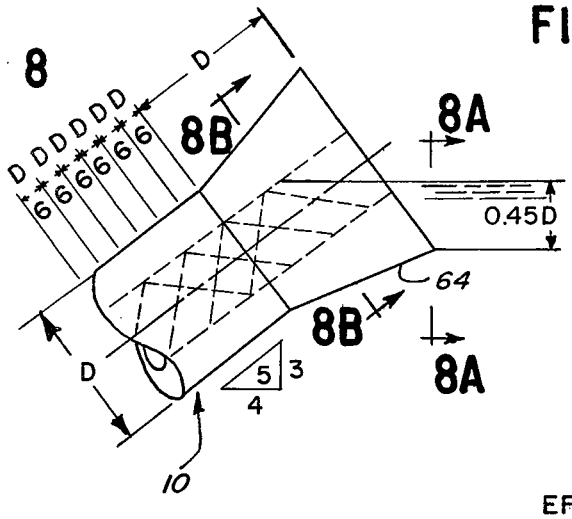
FIG. 8A
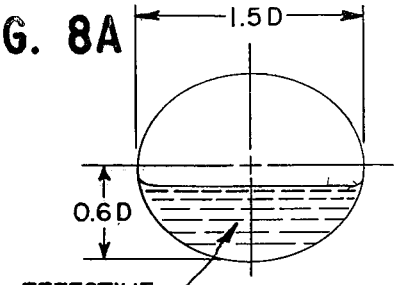
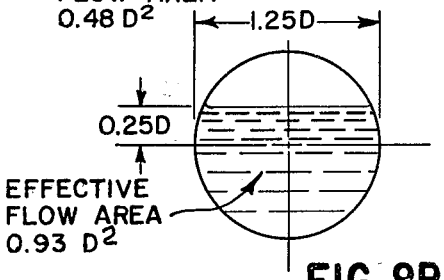
FIG. 8B
FIG. 9
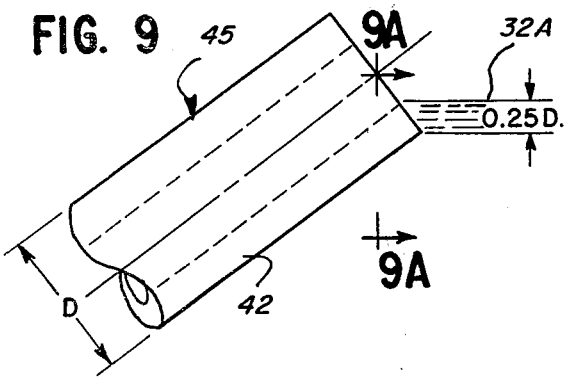
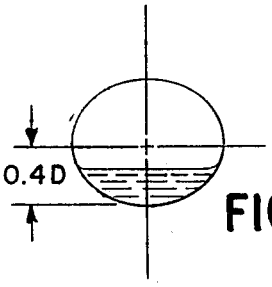
FIG. 9A
EFFECTIVE FLOW AREA $\underline{0.16\ D^2}$
WITH $Q = 1.65\ D^2$
MAX. OUTLET $V = 10^+$ FPS
TOO HIGH
FIG. 10
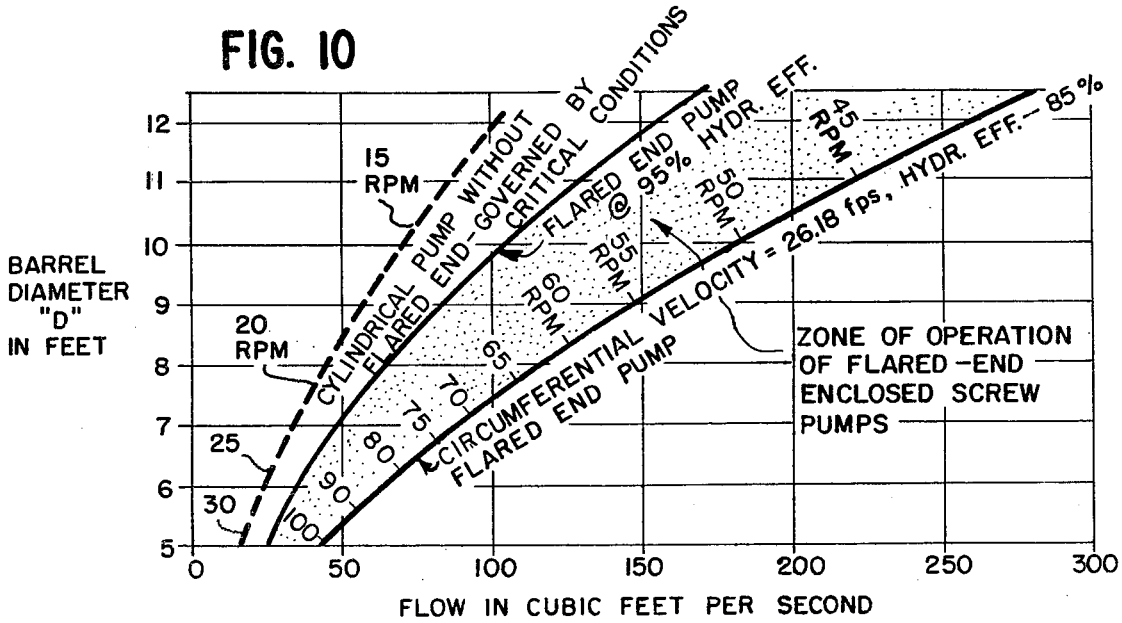

SCREW PUMP CONSTRUCTION

This invention pertains to a hydraulic screw pump construction and more particularly relates to a screw pump having increased discharge capacity for a given diameter.

Screw pumps are well-known in the art having been in use before or since the time of Archimedes. Such pumps are inclined to the horizontal and comprise a rotating blade or auger mounted on a shaft which rotates relative to an open half-round cylinder, or which rotates relative to a fully encompassing cylinder. More recent designs provide a blade or blades which are integrally fastened to an encompassing cylinder which then rotates with the blade or blades. Water or other pumpable liquid is carried in the compartments bounded by the blade surfaces and the encompassing cylinder and is moved from a lower pump entrance end to a higher discharge end. Enclosed screw pumps in which the blade rotates within a stationary cylindrical casing are the most primitive type and are in common use today in many underdeveloped countries of the world. The open half cylinder pump is that most commonly used in sewage treatment plants in the U.S.

A relatively recent development in screw pumps comprises one in which the fluid-moving blades are supportably welded to the inner periphery of the encompassing outer cylinder and utilizes no inner cylinder whereby the blade and cylinder rotate as a unit.

In constructions in which the blade outer ends and cylindrical casing are welded together as an integral unit there is no opportunity for solids disposed in the pumpable material to wedge between the blade flights and the encompassing cylinder. Leakage of the pumped liquid between the blades and the encompassing cylinder is, of course, also eliminated by such designs resulting in high pump efficiency.

All screw pumps including those referred to above function by the formation of chambers bounded by the helical blades, the cylindrical outer channel, and a normally-employed cylindrical inner channel about which the pump blades are disposed. Maximum discharge is achieved when these chambers are filled just to the point of overflowing down into the next lower chamber.

A limitation exists at the elevated pump discharge end which determines the maximum liquid discharge. Maximum discharge from a pump of the type described occurs at "critical" flow conditions. Such critical conditions require the least energy for a given rate of discharge; critical flow conditions in open channel flow are in accordance with the following formula:

$$V_c^2/2g = \tfrac{1}{2}y_c,$$

wherein $V_c$ is critical velocity in feet per second, g is the acceleration of gravity of 32 feet per second per second, and $y_c$ is the average depth of the liquid in the open channel at which critical flow occurs. Thus in accordance with this well-established principle of fluid mechanics, critical flow occurs in the discharge end of a screw pump when the velocity head ($V_c^2/2g$ of the above formula) is equal to one-half of the average depth of the flow ($y_c$ of the above formula) in the discharging pump end.

The maximum possible discharge of any screw pump is limited by the universal law of critical flow in open channels. Assuming that one would attempt to exceed this natural limit in a given pump by increasing the speed of rotation, the result would be to produce a spilling back down the pump of the excess water which would be pumped up by the increased speed of rotation but which would be unable to escape from the discharge end because of the such law of critical flow.

In accordance with this invention, screw pumps of the type above-mentioned are flared at their discharge ends so as to increase the critical liquid depth and flow area over the pump discharge lip. The cross-sectional area of the critical condition flow from the pump discharge end is accordingly increased thereby greatly increasing the pump capacity as will hereinafter be explained in greater detail.

It is an object of this invention, therefore, to increase the magnitude of the critical flow of screw-type pumps by the expedient of flaring the discharge ends thereof so as to increase the permissible critical flow depth, area and discharge rate therethrough.

It is another object of this invention to provide structural features for incorporation with a variety of specific pump constructions, the discharge capacity of which will be increased.

It is yet another object of this invention to provide a screw pump construction in which an upper seal is employed between the liquid-receiving channel and the pump discharge end to maximize efficiency of input energy utilization by minimizing the necessary pump lift of the conveyed liquid. Such a pump construction employing a seal also enables the pump blade direction of rotation to be reversed thus allowing liquid to flow through the pump in the opposite direction so that it may also function as a power-generating turbine as liquid flows from the upper channel to the lower pump end.

The above and other objects of this invention will become more apparent from the following detailed description when read in the light of the drawing and the appended claims.

The utility of the provided invention is apparent from the following example.

An enclosed screw pump inclined at an angle of about 38° to the horizontal and having a uniform 10-foot diameter has a maximum liquid discharge of about 71 cubic feet per second. By outwardly flaring the pump discharge end to a maximum diameter of 15 feet, a pump made in accordance with this invention had the critical depth of liquid in the discharge end increased. The possible liquid discharge rate of such pump may be easily double that of the discharge rate of the constant diameter pump as will hereinafter be explained in greater detail.

For a more complete understanding of this invention reference will now be made to the drawing wherein:

FIG. 1 is a fragmentary perspective view illustrating a discharge portion of a screw pump made in accordance with this invention having a flared outlet;

FIG. 2 is a sectional view taken on line 2—2 of FIG. 3;

FIG. 3 is a sectional view of a screw pump made in accordance with this invention having a flared discharge end together with apparatus for mounting and driving the same;

FIG. 4 is a fragmentary perspective view of open screw pumps as normally employed in the prior art for sewage conveying purposes, but with upper ends flared as taught by this invention;

FIG. 5 is a fragmentary perspective view illustrated on an enlarged scale, showing in detail the nature of the seal between the discharging end of the flared discharge end of the pump of FIG. 2 and the channel into which the pump discharges;

FIG. 8 is a schematic view illustrating a typical angular disposition of a screw pump made in accordance with this invention and utilizing a flared discharge end;

FIG. 8A is a sectional view taken on the line 8A—8A of FIG. 8;

FIG. 8B is a sectional view taken on line 8B—8B of FIG. 8 illustrating an effective flow area in said section of the schematically illustrated pump;

FIG. 9 is a fragmentary elevational view similar to that of FIG. 8 of a screw pump made in accordance with the prior art;

FIG. 9A is a sectional view taken on line 9A—9A of FIG. 9; and

FIG. 10 is a graph illustrating permissible flows for screw pumps made in accordance with the prior art and made in accordance with the teachings of this invention.

Figure 7:
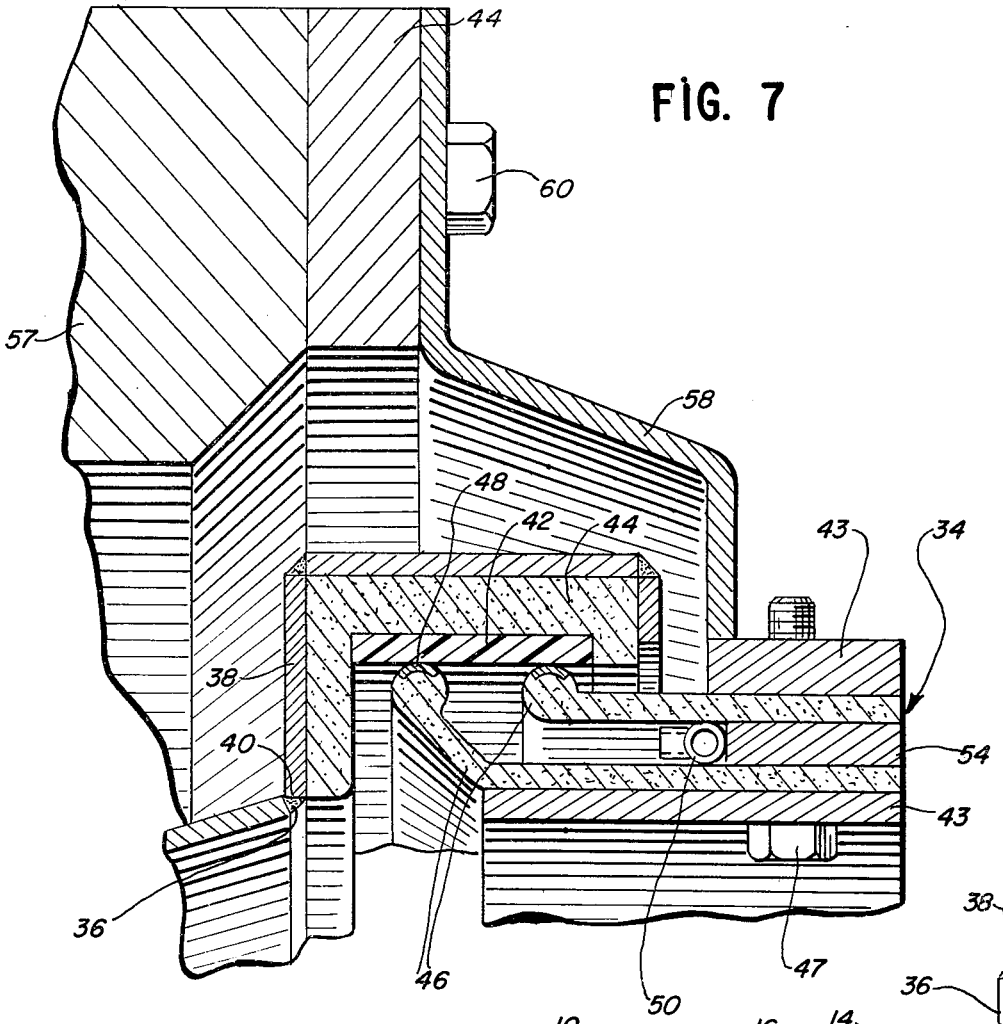
FIG. 7 is an enlarged fragmentary sectional view illustrating a seal arrangement which may be employed with an enclosed screw pump made in accordance with the teachings of this invention.

Referring now more particularly to FIG. 1, a fragment of a screw pump 10 made in accordance with the teaching of this invention is illustrated having an outer casing 15 comprising a cylindrical shell portion 12 integrally formed with a flared discharge end portion 14. Disposed within the flared-end casing are rotatable helical blades 16 mounted on an inner reinforcing cylinder 18 as is more clearly seen from FIGS. 2 and 3. It will be clearly seen from FIG. 2 that pump 10 employs a three-bladed screw in which the blades 16 are disposed at 120° intervals about the periphery of inner cylinder 18. Cylinder 18 is rotatably mounted in upper bearing 20 and lower bearing 22. The inner cylinder 18 and blades 16 are integrally joined with casing 15 whereby the blade-cylinder assembly may rotate as a unit in bearings 20, 22. Other blade arrangements such as one, two or four blades may be employed, three being given by way of example only.

It will be noted from FIG. 3 that lower end portion of casing 15 is also flared at 24 to decrease the contraction of the incoming fluid stream and thereby increase the efficiency of the pumping operation. The pump 10 mounted in bearings 20 and 22 is rotatably driven by motor 26 through gear box 27 which is mounted on the concrete support 28 or a similar supporting structure. As an alternative pump rotating means, roller bearings may be mounted about a cylindrical peripheral portion of the casing and driven by a motor through a connecting chain belt or the like. Such a drive is commonly more expensive than that illustrated in the drawings.

As is apparent from FIG. 3, the function of screw pump 10 is to pump liquid from lower level 30 to upper channel 32. The liquid entering at the lower casing end is raised by the flights of the blade 16 in "steps" as blades 18 rotate within the pump casing as graphically illustrated in FIG. 8.

Slidably engaging the lower peripheral half of rotating flared casing portion 14 is a seal 34 which extends above level L in channel 32 (see FIG. 5). The seal minimizes the energy which need be expended to lift the liquid from lower level 30 to upper channel 32. Rather than being elevated above level L in channel 32 the pump 10 discharges the liquid directly into channel 32 and does not discharge liquid above it, resulting in an obvious energy saving. Thus, the liquid flows from the pump discharge end into channel 32 with very little energy loss. Such even discharge into channel 32 eliminates any erosion caused by dropping liquid discharge from pump 10, if the discharge end is disposed above level L in channel 32. Such energy saving would commonly be as high as ten to fifty percent in pump settings most often employed.

Figure 6:
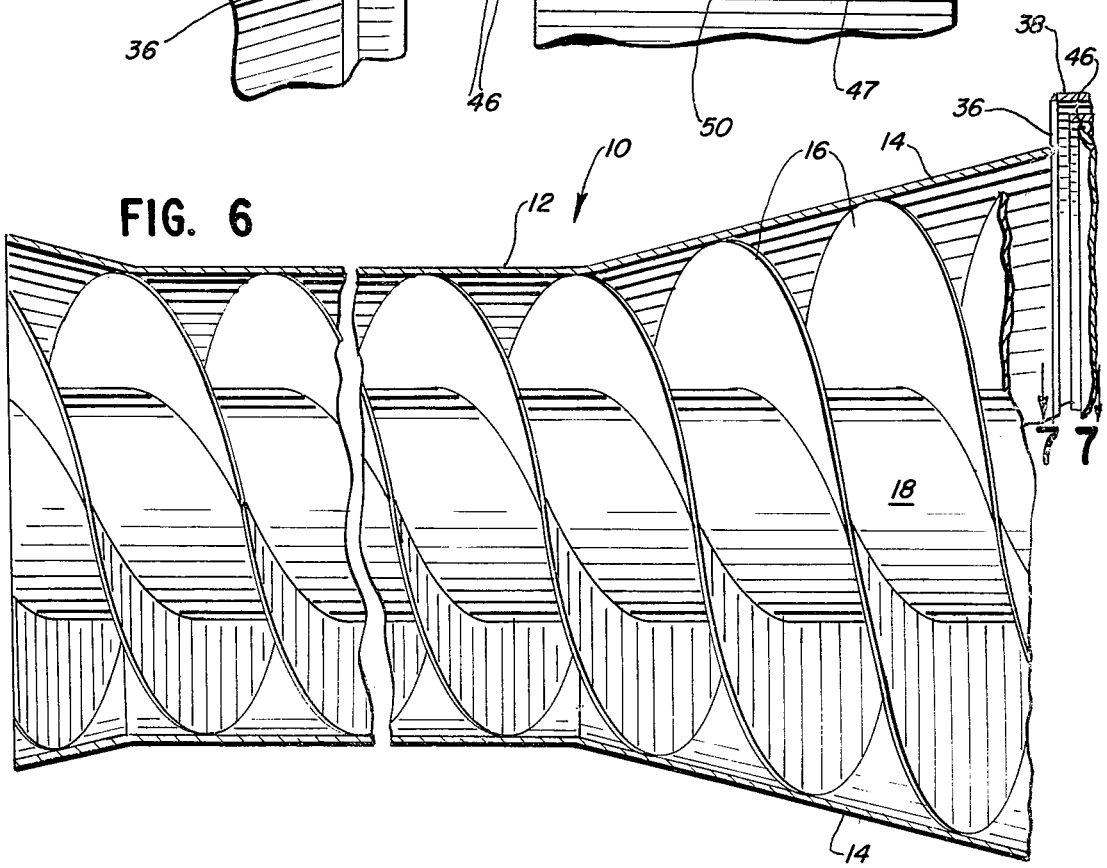
FIG. 6 is a fragmentary sectional view of the pump of FIG. 3.

It will be noted from FIGS. 6 and 7 that annular periphery 36 of flared discharge end 14 of the casing 12 of pump 10 is formed with a peripheral lip 38. Lip 38 is of substantially L-shaped sectional configuration and extends from the end of the pump flared terminal end 36 in the manner most clearly seen in FIGS. 6 and 7. The L-shaped lip 38 which may be welded at 40 or otherwise suitably secured to the annular periphery 36 of the pump has an annular, low-friction ring 42 formed of a material such as that sold under the trade name Oilon, located within the pump lip 38 embedded in a filler material 44 which may be formed of a variety of materials such as plastics. The foregoing seal construction is integrally formed with and supported by the rotating pump 10. In sealing engagement with the inner periphery of the Oilon ring 34 are resilient plastic or rubber "music seal" strips 46 more clearly seen in FIG. 7. Inserts 48 of wear-resistant material having a low coefficient of friction slidably engage the Oilon ring 42. The seals are flexible annular strips which effect a fluid-tight seal where engaging the rotary ring 42 attached to the pump 10. The seals prevent liquid escape between the concrete mounting the pump and defining upper channel 32 and the pump forcing all the pumped liquid into the channel 32. The "music note" seal strips 46 are lockingly sandwiched between locking rings 43 with the assistance of bolts 47 traversing the ring assembly at spaced intervals as illustrated. A supporting bracket ring 58 supports the ring assembly and is also traversed by bolts 47. Anchoring bolts 60 embedded in the concrete 57 support the seal assembly at opposed arcuate ends.

Supply conduit 50 disposed between the annular "music note" seals 46, illustrated in section in FIG. 7, discharges oil or equivalent lubricant into the interval between the music note seal ring so as to provide a low-friction engagement between the inserts 48 of the music note seals and the Oilon strip which is rotatable with the casing discharge end of the pump 10. The oil discharge provides a slight positive pressure preventing water from entering between the seal strips as the oil slowly bleeds past the sealing surfaces.

A further benefit made possible by means of the seal 34 is the resulting ability of the pump to be employed if desired as a turbine by allowing the blades 16 to rotate in an opposite direction to that employed when pumping. Thus if motor 26 is de-energized and the positive flow of liquid from the pump discharge end terminates, liquid in the channel 32 flows into the pump discharge end. The liquid in the channel then flows into the flared end 14 of the pump to the lower level 30 illustrated in FIG. 1. The use of the provided seal enables the provided pump to efficiently function both as an energy saving screw pump and, in addition, enables the provided construction to serve as an energy-generating water turbine when water is allowed to enter the flared discharge opening for blade and unit turning purposes. The pump in its "turbine" state may be connected to an alternator in manners well-known in the art for electricity generating purposes. Governing mechanisms well-known in the art could be employed to regulate speed of rotation when the invention would be employed as a turbine.

As above noted, the flared end of the pump 10 of this invention enables the maximum flow rate occurring at critical flow conditions to be dramatically increased. Although the pump 10 employs a uniformly enlarging casing end portion 14 defining a cone frustrum, the enlargement of the discharge end may be of other configuration and provide the desired increase in critical flow conditions and rate of discharge. The enlargements should not interfere with liquid discharge from the pump by creating undesired friction losses.

The utility of this invention will become apparent by now referring to FIG. 9 wherein a screw pump 45 schematically illustrated has a cylindrical casing 42 with three blades secured to an inner cylinder disposed therein in the manner of pump 10 of FIG. 3. The inner cylinder, blades and outer cylinder 42 are rotatable as a unit in the manner above mentioned in the description of pump 10. The pump 45 is thus the same as pump 10 of the drawing with the exception that it has no flared end and is representative of known screw pumps of the prior art.

Assuming that the illustrated angle of the pump 45 in FIG. 9 is approximately 38° relative to the horizontal, it will be noted that the water level in the discharging end of the pump which end comprises a continuation of open channel 32*a*, is 0.25D of the outer cylinder diameter as illustrated. At critical flow conditions at which maximum discharge occurs, the 0.25D maximum depth also comprises an average depth component in the discharge channel of eliptical section of 0.13D (Yc of the critical flow formula above given) and the energy or velocity head component is ½ yc or 0.065D. Whereas the effective flow area of the discharge end of pump 45 illustrated in FIG. 9A is $0.16D^2$ at critical flow, the critical flow area portion thereof determinative of the maximum rate of flow is only $0.1098D^2$ which for a 10 foot diameter pump provides a maximum rate of discharge of approximately 71 cubic feet per second. Such discharge of pump 45 having a three-bladed screw would employ a pump rotational speed of 15.51 rpm.

Utilizing pump 10 illustrated in FIG. 3 and schematically depicted in FIG. 8, the flared end portion 14 of casing 12 increases the critical depth of the liquid over the casing terminus 40 from 0.25D to 0.45D. The effective flow areas in the flared discharge end of the pump are increased as indicated by the two sectional views of FIGS. 8A and 8B. Most importantly the critical flow from the discharge end of pump 10 is substantially increased owing to both the greater depth of flow and also the greater width of the flared end 14 which has a maximum diameter of 15 feet. The theoretical critical flow discharge of the pump 10 is approximately 370 cubic feet per second which comprises in excess of 500% of the theoretical maximum rate of discharge of pump 45 of FIG. 9. As above noted, pump 45 is of precisely the same construction as pump 10, the sole structural difference comprises the flared casing portion 14 present in pump 10.

However, such a rate of discharge (370 c.f.s.) would entail a theoretical speed of pump rotation of 80.84 rpm for the three-bladed screw pump disclosed, each blade forming a fluid-holding compartment of 91.54 cubic feet. Thus for pump 10 to discharge 370 cubic feet/sec. it must rotate at 80.84 revolutions per minute. For a 10 foot diameter pump this would be equivalent to a pump surface speed of 42.31 feet per second.

Such a speed would create intolerable frictional losses in the pump resulting in high inefficiency. Thus to limit such losses, the rotational speed is limited to 40 rpm which is an acceptable speed for pumps of the size of pump 10 and which will not generate excessive friction losses. Such speed of rotation effects a maximum discharge of about 183 cubic feet per second, a rate of discharge 250 percent of the maximum theoretical discharge rate of pump 45.

FIG. 10 comprises a chart comparing the quantity of flow of pumps made in accordance with the disclosed invention (arcuate band) with pumps of the prior art (dashed line) which are cylindrical throughout their length. The flow quantities of FIG. 10 are charted as a function of the pump diameter. The pumps of this application are found in FIG. 10 in a band defined by 85% and 95% efficiency curves. The permitted increasing speed of pump rotaton being apparent as the pump size decreases. It is apparent from FIG. 10 that a larger diameter pump will operate at a higher efficiency than a smaller diameter pump rotating at a higher speed to provide the same discharge flow. Such reduced efficiency results from the increased frictional losses and back splashing as the pump speed of rotation increases.

The provided pump-seal system above described provides energy savings and attendant benefits above described in detail. Significant savings in capital outlays and operating costs are obtained in using such sealed pumps by virtue of the smaller energy input for raising the pumpable material to a lesser height as well as by virtue of the smaller motor and drive units required. The reversibility of the provided pump into an electricity-generating turbine has also been discussed above.

The provided invention is applicable to open screw pumps, such as pumps 70 (FIG. 4) in which the rotating blades 72 are rotatably mounted in concrete half cylinders 74. Discharge ends of the concrete troughs or flumes are flared at 78 for purposes of obtaining the benefit of the disclosed invention. The provided invention should normally be able to provide at least a 50% gain in screw pump capacity. Because of such increased capacity of pumps utilizing the invention herein disclosed, pumps employing the same may rotate at increased speeds of rotation up to an efficiency-dictated maximum. Since the rotational speeds of screw pumps are notoriously small relative to the normal rotational speeds of electric motors, screw pumps require the use of speed reducers such as reducer 27 of FIG. 3, the speed reduction problem is minimized as the rotational speed of the pump screw is increased.

The provided invention overcomes the limitation of critical flow by increasing the permitted rate of discharge of a screw pump through an increase in the pump diameter at its discharging end. For ordinary cylindrical screw pumps, critical flow is given by the following type of formula: $Q=KD^{5/2}$ in which Q is the maximum discharge without excessive spillage and backflow, K is a constant dependent upon the pump angle of inclination and number of pump blades and D is the outer diameter of the cylindrical pump. It is thus apparent that a small increase in "D" of the above equation results in a significant increase in flow capacity. Thus, for example, a 10% increase in D is able to produce a 26.9% increase in hydraulic capacity which may be achieved by a 26.9% increase in rotational speed if excessive frictional losses are not generated.

The provided invention in addition to providing the many advantages above set forth, is adaptable for a variety of pump applications as in sewage pumping, flood control, pumping of cooling water and process water pumping stations. The higher pump efficiencies made possible by this invention enable higher speeds of rotation to be employed for a given desired rate of discharge regardless as to whether the liquid pumped is plain water or debris laden.

The pumps disclosed in the drawing are presented by way of example only, as the flexibility in utilization of the provided invention is believed to be apparent from the foregoing. This invention is to be limited therefore only by the scope of the appended claims.

What is claimed is:

1. A pumping system comprising an inclined screw pump having a casing with a lower intake end disposed in a lower liquid level and an upper discharge end discharging into an open channel disposed above said lower liquid level; compartment-forming blade means disposed within said casing joined to the inner periphery thereof; means mounting said blade-means and casing for rotatable movement whereby liquid enters said pump intake end and is conveyed along the length of said blade means to said pump discharge end; said pump discharge end being flared to a maximum diameter at the terminal end thereof; an annular projecting lip extending from said terminal end concentric with the pump longitudinal axis; stationary sealing strips mounted adjacent the rotatable end of said pump casing slidably engaging said pump projecting lip in fluid-sealing engagement; said sealing strips effecting a fluid seal between said rotating pump discharge end and said channel whereby said pump liquid discharge is forced to flow away from said pump in said open channel; the lowest point on said pump discharge end being disposed in said open channel and said stationary sealing strips extending to a height above the liquid level in said open channel.

2. The system of claim 1 in which a wear-resistant ring engaging said sealing strips is mounted in said annular projecting lip, and lubricant discharging means is interposed said sealing strips.

* * * * *